US006644494B2

(12) United States Patent
Hayes et al.

(10) Patent No.: US 6,644,494 B2
(45) Date of Patent: Nov. 11, 2003

(54) SMOOTHWALL HINGED CONTAINERS

(75) Inventors: Thomas J. Hayes, McHenry, IL (US); Brian J. Cammarata, Farmington, NY (US); William Loiselle, Lindenhurst, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/953,516

(22) Filed: Sep. 14, 2001

(65) Prior Publication Data

US 2003/0052125 A1 Mar. 20, 2003

(51) Int. Cl.[7] ..... B65D 21/02; B65D 51/16; B65D 43/16

(52) U.S. Cl. ..... 220/839; 220/835; 220/366.1; 220/367.1; 220/608; 206/508; 206/509

(58) Field of Search ..... 220/4.21–4.24, 220/835, 837, 839, 781, 380, 366.1, 367.1, 608, 609; 206/508, 509

(56) References Cited

U.S. PATENT DOCUMENTS

| | | | | |
|---|---|---|---|---|
| 3,253,762 A | | 5/1966 | Gaunt | |
| 3,583,623 A | * | 6/1971 | Golner et al. | 220/608 |
| 3,613,938 A | | 10/1971 | Westcott | |
| 3,907,195 A | | 9/1975 | Struble | |
| 3,912,118 A | | 10/1975 | Bird | |
| 4,034,907 A | | 7/1977 | Engdahl, Jr. | |
| 4,206,845 A | | 6/1980 | Christian | |
| 4,264,031 A | | 4/1981 | Goebel | |
| 4,390,113 A | | 6/1983 | Bird | |
| D276,216 S | | 11/1984 | Michaud | |
| 4,664,281 A | | 5/1987 | Falk et al. | |
| 4,704,510 A | | 11/1987 | Matsui | |
| 4,741,452 A | | 5/1988 | Holzkopf | |
| 4,771,934 A | | 9/1988 | Kalmanides | |
| 4,844,263 A | * | 7/1989 | Hadtke | 206/508 |
| 4,859,822 A | | 8/1989 | Ragusa et al. | |
| 4,883,195 A | | 11/1989 | Ott et al. | |
| 4,974,738 A | | 12/1990 | Kidd et al. | |
| D315,100 S | | 3/1991 | Sheehan | |
| 5,065,889 A | | 11/1991 | Conti | |
| 5,069,344 A | | 12/1991 | Dehart | |
| 5,076,459 A | | 12/1991 | DeHart | |
| D333,094 S | | 2/1993 | Zutler | |
| D339,744 S | | 9/1993 | Seppala | |
| D343,576 S | | 1/1994 | Krupa | |
| D345,894 S | | 4/1994 | Krupa | |

(List continued on next page.)

FOREIGN PATENT DOCUMENTS

| | | |
|---|---|---|
| DE | 857 860 | 12/1952 |
| GB | 2 160 510 A | 12/1985 |
| GB | 2 200 340 A | 8/1988 |

OTHER PUBLICATIONS

PCT Internationl Search Report for International Application No. PCT/US02/29251, filed Sep. 12, 2002; dated Dec. 6, 2002; (4 pages).

(List continued on next page.)

*Primary Examiner*—Nathan J. Newhouse
(74) *Attorney, Agent, or Firm*—Jenkens & Gilchrist

(57) ABSTRACT

A hinged container includes a basket having a base, a pair of sidewalls, and a pair of endwalls. The pair of sidewalls and the pair of endwalls integrally extend outwardly to form a first latching portion. A concave channel, a first concave region, and a second concave region are all formed in the base. The concave channel extends along a major axis of the base, while the first concave region extends from the concave channel to one of the pair of sidewalls, and the second concave region extends from the concave channel to the other of the pair of sidewalls. A lid is hingedly connected to the first latching portion. The lid includes a second latching portion corresponding to the first latching portion. The first and second latching portions lock together to retain the lid and the basket in a closed relationship.

51 Claims, 6 Drawing Sheets

U.S. PATENT DOCUMENTS

| | | | | |
|---|---|---|---|---|
| D348,608 | S | | 7/1994 | Wyslotsky |
| 5,339,973 | A | | 8/1994 | Edwards et al. |
| D354,436 | S | | 1/1995 | Krupa |
| 5,423,453 | A | | 6/1995 | Fritz |
| D361,035 | S | | 8/1995 | Krupa |
| D361,036 | S | | 8/1995 | Krupa |
| D363,022 | S | | 10/1995 | Krupa et al. |
| 5,456,379 | A | | 10/1995 | Krupa et al. |
| D363,879 | S | | 11/1995 | Krupa et al. |
| 5,515,993 | A | | 5/1996 | McManus |
| D376,314 | S | | 12/1996 | Krupa |
| D378,192 | S | | 2/1997 | Krupa et al. |
| D379,300 | S | | 5/1997 | Krupa et al. |
| D380,381 | S | | 7/1997 | Krupa et al. |
| D382,795 | S | | 8/1997 | Abayhan et al. |
| D385,784 | S | | 11/1997 | Krupa et al. |
| D393,204 | S | | 4/1998 | Goins et al. |
| 5,738,890 | A | | 4/1998 | Cadiente et al. |
| 5,833,116 | A | | 11/1998 | Guillin |
| D409,485 | S | | 5/1999 | Christy, Jr. |
| 5,947,321 | A | | 9/1999 | Vadney |
| 6,007,854 | A | | 12/1999 | Cadiente et al. |
| 6,074,676 | A | | 6/2000 | Cadiente et al. |
| 6,085,930 | A | * | 7/2000 | Curtis ..... 206/508 |
| 6,257,401 | B1 | | 7/2001 | Mangla et al. |
| D446,017 | S | * | 8/2001 | Koefelda ..... D3/307 |
| D448,288 | S | | 9/2001 | Zettle et al. |
| 6,308,858 | B1 | | 10/2001 | Koefelda |
| 6,367,651 | B2 | | 4/2002 | Laib et al. |
| 6,390,357 | B1 | | 5/2002 | Ogryzlo et al. |
| D473,137 | S | | 4/2003 | Cadiente et al. |

OTHER PUBLICATIONS

Description of MIXIM's Clamshell Container from Sambrailo Packaging (date unknown) 1 page; Sambrailo Packaging—Berry Produce and Flower Packaging Solutions—pages from website www.sambrailo.com, (printed Apr. 18, 2003) 4 pages; 2 drawing pages (prepared on Apr. 21, 2003).

Packaging Corporation Of America, Packaging the World Specification Catalog, 4 pages (Feb. 1992).

* cited by examiner

SMOOTHWALL HINGED CONTAINERS

FIELD OF THE INVENTION

This invention relates generally to hinged containers, and more specifically to smoothwall hinged containers having vents for increasing the circulation through the containers.

BACKGROUND OF THE INVENTION

Oftentimes, fruit is put in a container right after being picked, and the fruit is transported in this container to the retailer for selling. Many containers with fruit are transported long distances before reaching their final destination. During the transit, the fruit may become bruised due to a variety of causes. For example, the fruit may experience a lot of jostling, resulting in bouncing against other fruit or walls of the container. Also, the fruit may be smashed into a corner of the container. If bruised fruit is found by a seller, it is discarded as scrap and, therefore, counts as a loss. If the seller does not notice the bruised fruit and it is purchased by a consumer, this can result in customer dissatisfaction.

Another problem associated with transporting certain fruit is spoilage. Some fruits need to be kept cold to retain their freshness during transit and up until they are sold to a customer. To keep the fruit inside the container cool, refrigerated trucks are used that circulate air while the containers are in transit.

Since numerous pieces of fruit are often in one container, however, it is difficult to keep the fruit cool by only circulating air around the container. Containers have been developed that include vents in the bottom and along the sides of the container to increase airflow therethrough. In these containers, air is circulated not only around the outside, but some of the air flows into the container and circulates around the fruit.

These existing containers, however, do not adequately circulate air therethrough. There is still fruit on the inside of the container that may not be kept cool through these circulation efforts. The containers are often stacked on top of each other, and the cool air never reaches the venting apertures in the bottom of some of the containers.

Thus, there is a need for a container that improves the transport of fruit by reducing or inhibiting bruising and/or improving air circulation.

SUMMARY OF THE INVENTION

A hinged container includes a basket having a base, a pair of sidewalls, and a pair of endwalls. The pair of sidewalls and the pair of endwalls integrally extend outwardly to form a first latching portion. A concave channel, a first concave region, and a second concave region are all formed in the base. The concave channel extends along a major axis of the base, while the first concave region extends from the concave channel to one of the pair of sidewalls, and the second concave region extends from the concave channel to the other of the pair of sidewalls. A lid is hingedly connected to the first latching portion. The lid includes a second latching portion corresponding to the first latching portion. The first and second latching portions lock together to retain the lid and the basket in a closed relationship.

BRIEF DESCRIPTION OF THE DRAWINGS

The foregoing and other advantages of the invention will become apparent upon reading the following detailed description and upon reference to the drawings.

Figure 1:
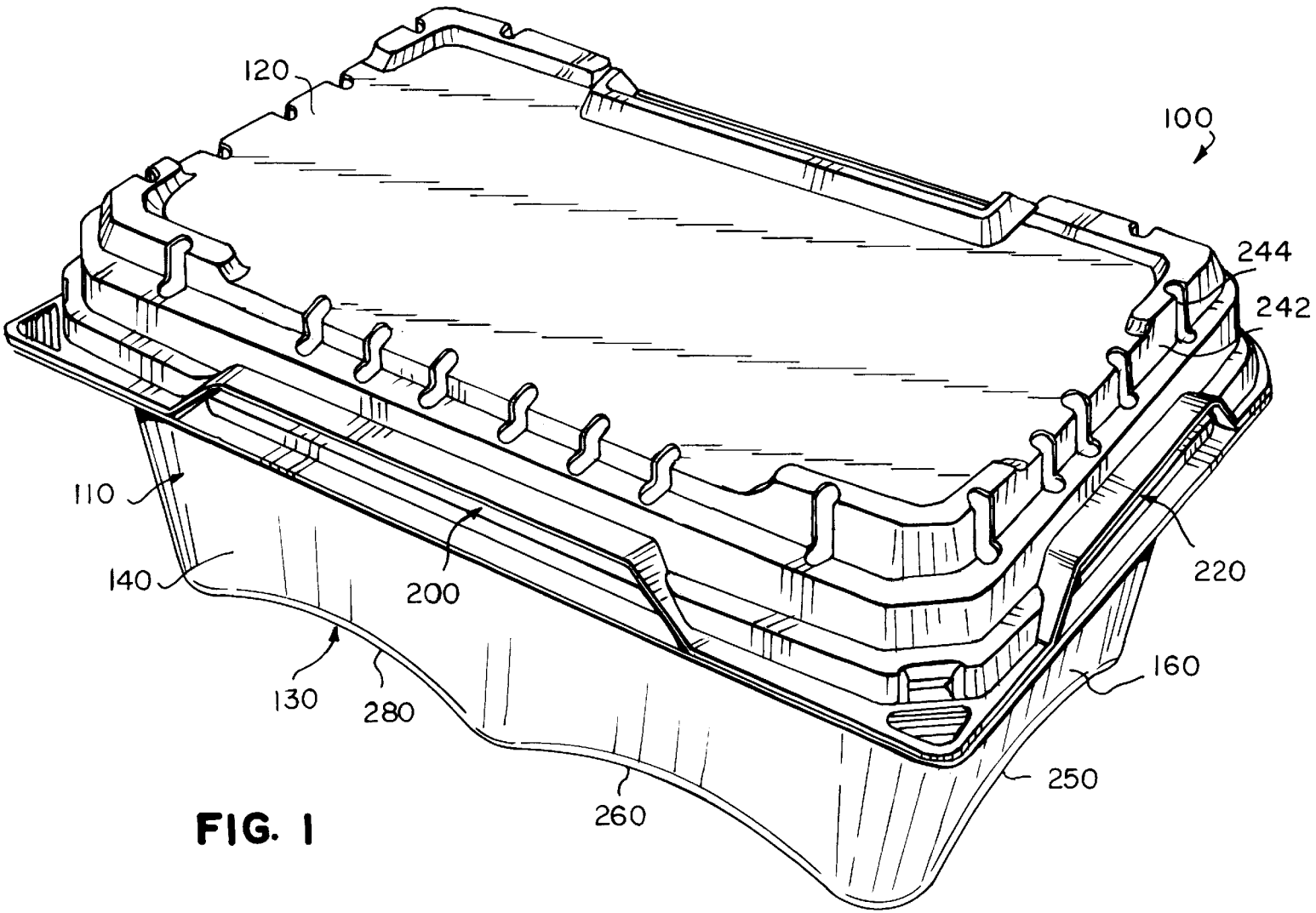
FIG. 1 is a perspective view of one embodiment of a container according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
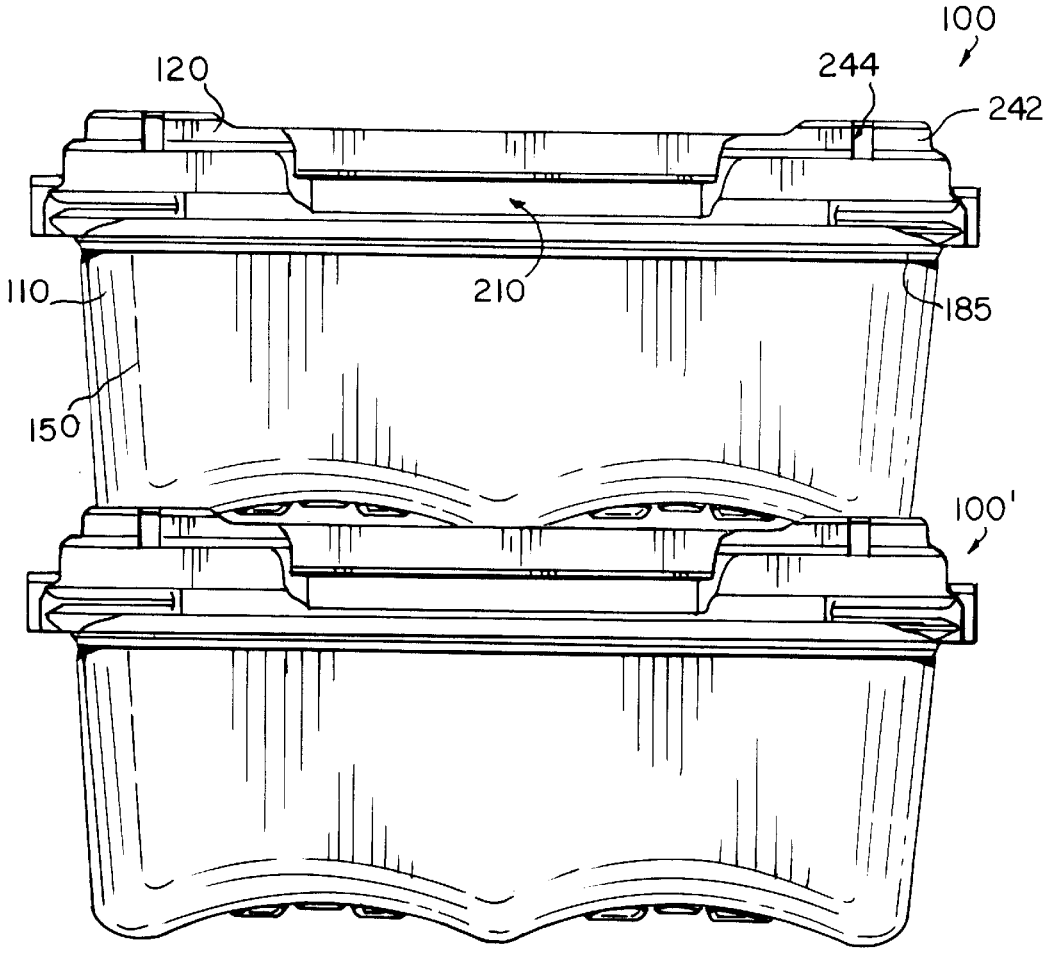
FIG. 2 is a side view of a stacked arrangement of two containers according to one embodiment of the present invention.
Figure 3:
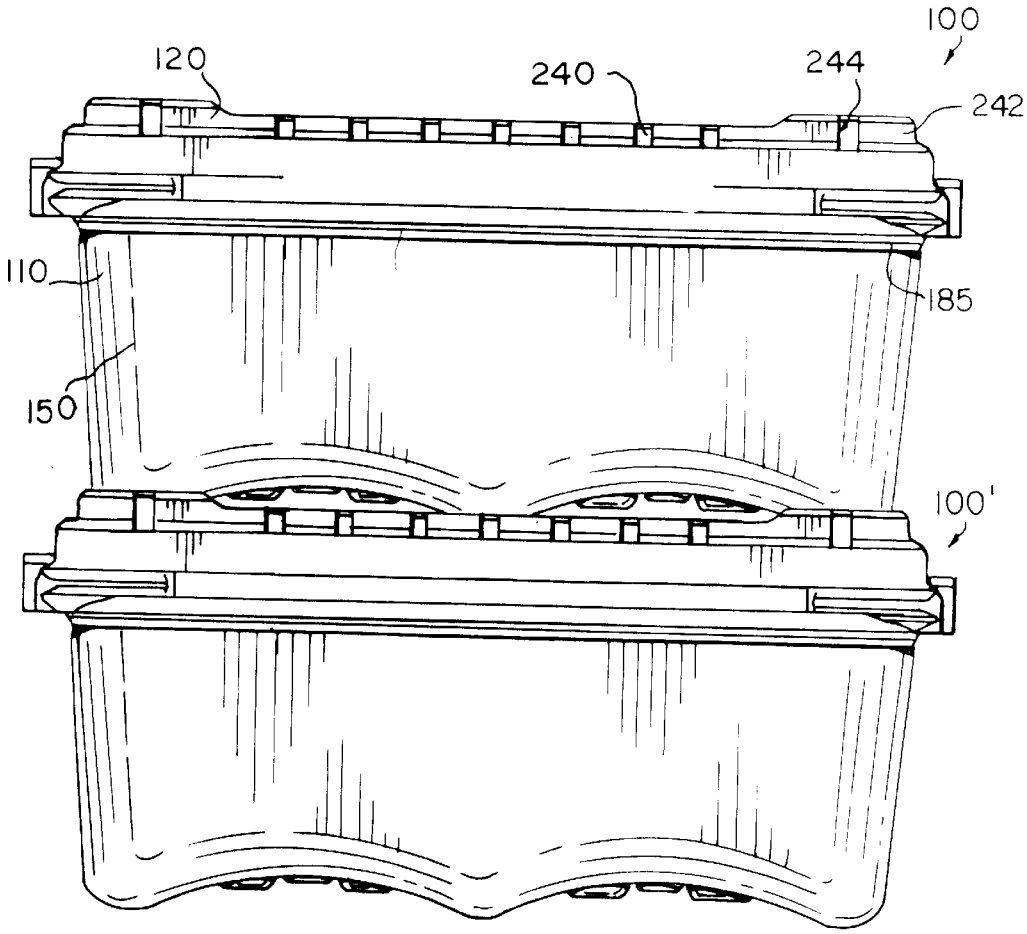
FIG. 3 is a side view of the container according to another embodiment of the present invention.

Referring now to FIGS. 1–4, a container 100 according to one embodiment of the present invention will be described. FIG. 1 is a perspective view of the container 100 according to one embodiment of the present invention and FIG. 2 is a side view of the container 100 in a stacked relationship with the container 100'. FIG. 3 is an alternative embodiment of the container 100 and FIGS. 4*a* and 4*b* illustrate end views of the container 100. The container 100 is adapted to carry materials, such as food products, during transport. For ease of description, the specification will refer to fruit as the item being carried, although the container may be used to transport other food products. Referring to FIGS. 1–4*b*, the container 100 comprises a basket 110 and a lid 120. The basket 110 comprises a base 130 and two opposing sidewalls 140, 150 integrally connected to two opposing endwalls 160, 170. The sidewalls 140, 150 and endwalls 160, 170 extend continuously upwardly from the base 130 and form a first latching portion 180. The endwalls 160, 170 and sidewalls 140, 150 are generally smooth and do not have any ribs. The smoothness of the endwalls 160, 170 and sidewalls 140, 150 provide a cushioning effect for the fruit that is transported in the container 100. This assists in inhibiting or reducing the fruit from becoming bruised because the ribless container 100 does not have any sharp edges. Thus, the smoothness of the sidewalls 140, 150 and endwalls 160, 170 lessen the likelihood of mechanical bruising (bruising of the fruit caused by the container) during transport.

The generally smooth sidewalls 140, 150 and generally smooth endwalls 160, 170 form gently curved corners. The curvature of the corners assists in inhibiting the bruising of the fruit by making it more difficult for fruit to be smashed into the corner and, thus, bruised or damaged. Thus, the curved corners also lessen the likelihood of mechanical bruising of the fruit during transport.

The generally smooth sidewalls 140, 150 are also generally flat relative to the inside of the basket 110. Since the sidewalls 140, 150 are generally flat, the "oil canning effect," or buckling of the sidewalls, is eliminated. The endwalls 160, 170 are also generally flat relative to the inside of the basket 110.

The lid 120 is hingedly connected to the first latching portion 180 via a hinge 185 and includes a second latching portion 190. The first latching portion 180 and the second latching portion 190 are configured to retain the lid 120 and basket 110 in a closed relationship. The first and second latching portions 180, 190 may be configured as is known in the art.

When the basket 110 and lid 120 are retained in a closed position, the first and second latching portions 180, 190 define a first ventilation slot 200 along one of the pair of sidewalls 140, 150. The first ventilation slot 200 allows air (e.g., cool air) to flow into the container 100. While fruit is being transported, it must remain cold to retain its freshness. The first ventilation slot 200 allows cool air to flow into the basket and, thus, cool the fruit.

In one embodiment of the present invention, the other of the pair of sidewalls 140, 150 defines a second ventilation slot 210 (FIG. 2). In the embodiment depicted, the second ventilation slot 210 is cut in a "step" formation, extending from the top of the lid 120 all the way to just above the hinge 185. In other embodiments, the second ventilation slot 210 may be a mirror of the first ventilation slot 200. The first and second ventilation slots 200, 210 are located generally opposite each other, so air may flow into one of the first and second ventilation slots 200, 210, through the container 100 and then out of the other of the first and second ventilation slots 200, 210. The second ventilation slot 210 is constructed so as to be in alignment with the first ventilation slot 200.

Figure 4A:
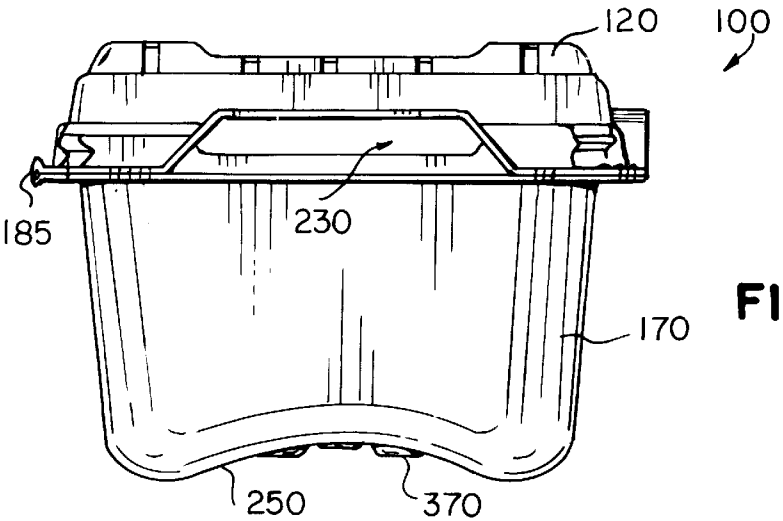
FIG. 4*a* is an end view of the container of FIG. 1 with the lid in a closed position.
Figure 4B:
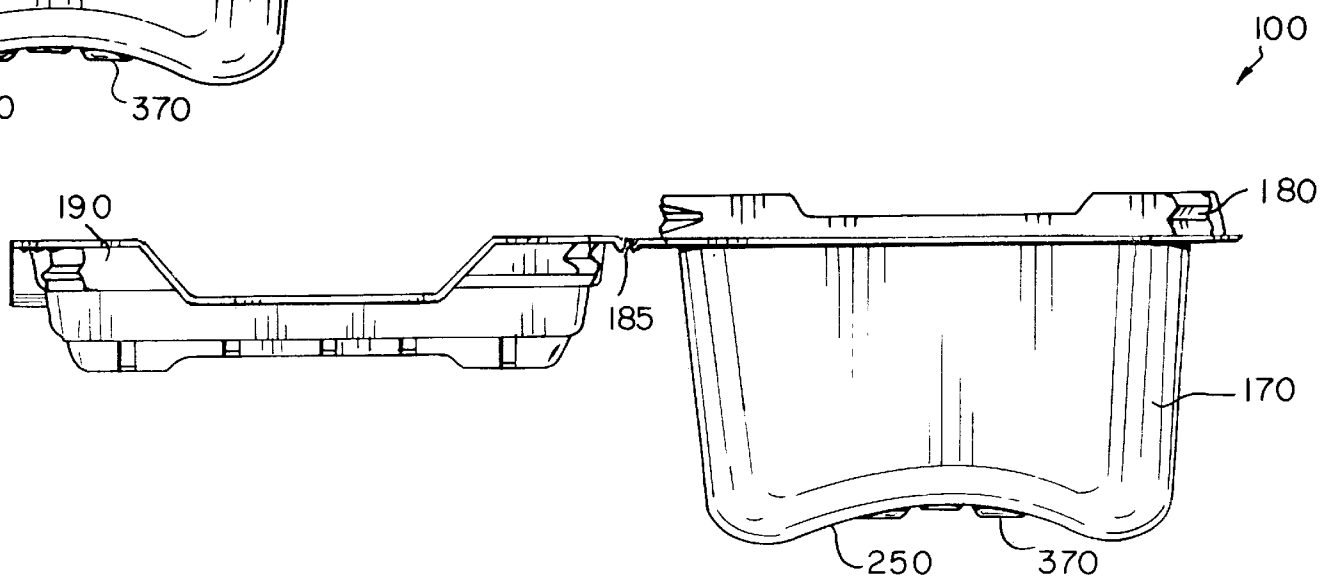
FIG. 4*b* is an end view of the container of FIG. 1 with the lid in an open position.

A third ventilation slot 220 and a fourth ventilation slot 230 are also defined by the first and second latching portions 180, 190 when in a closed position. The fourth ventilation slot 230 is best shown in FIG. 4A. The third ventilation slot 220 is located on one of the pair of endwalls 160, 170, while the fourth ventilation slot 230 is on the other of the pair of endwalls 160, 170. The third and fourth ventilation slots 220, 230 allow air to flow through the container 100 in a direction generally perpendicular to the air flowing into the container 100 from the first ventilation slot 200. Thus, the container 100 has increased circulation from the plurality of ventilation slots, which easily cool the fruit and maintain freshness.

In another embodiment, the first and second latching portions 180, 190 do not define a second ventilation slot when closed. Instead, the first latching portion 180 defines a plurality of ventilation apertures 240 (FIG. 3). The plurality of ventilation apertures 240 are in alignment with the first ventilation slot 200, so that air may flow through both the first ventilation slot 200 and the ventilation apertures 240.

The lid 120 also forms a rim 242 that extends at least partially around the edge of the lid. In FIG. 1, the rim 242 extends from the beginning of the second ventilation slot 210 around the rest of the lid 120, ending at the other end of the second ventilation slot 210. The rim 242 forms a plurality of rim ventilation apertures 244 that extend around the rim 242. As shown in FIG. 1, the rim ventilation apertures 244 are located above the first, third and fourth ventilation slots 200, 220, 230. Also, two of the rim ventilation apertures 244 are adjacent to the second ventilation slot 210. In the embodiments where the second ventilation slot 210 is not stepped and mirrors the first ventilation slot 200, the rim ventilation apertures may extend entirely around the rim 242. In some embodiments, the rim ventilation apertures 244 may only be on one side of the lid 120; in other embodiments, the rim 242 may not be included, and the lid 120 may form the ventilation apertures 244. Alternatively, the lid 120 may not have any rim ventilation apertures 244. Another feature designed to increase the cooling capabilities of the container 100 is a concave channel 250 that is formed in a direction parallel to a major axis of the base 130 (FIG. 1). During transport, the container 100 is stacked with other containers 100' (FIG. 2). When the containers 100, 100' are stacked, it is difficult to circulate the cool air therebetween, which may result in spoilage. The concave channel 250 that is formed along the base 130 allows air to flow under a stacked container 100 or even when the container 100 is set on a flat surface.

Figure 5:
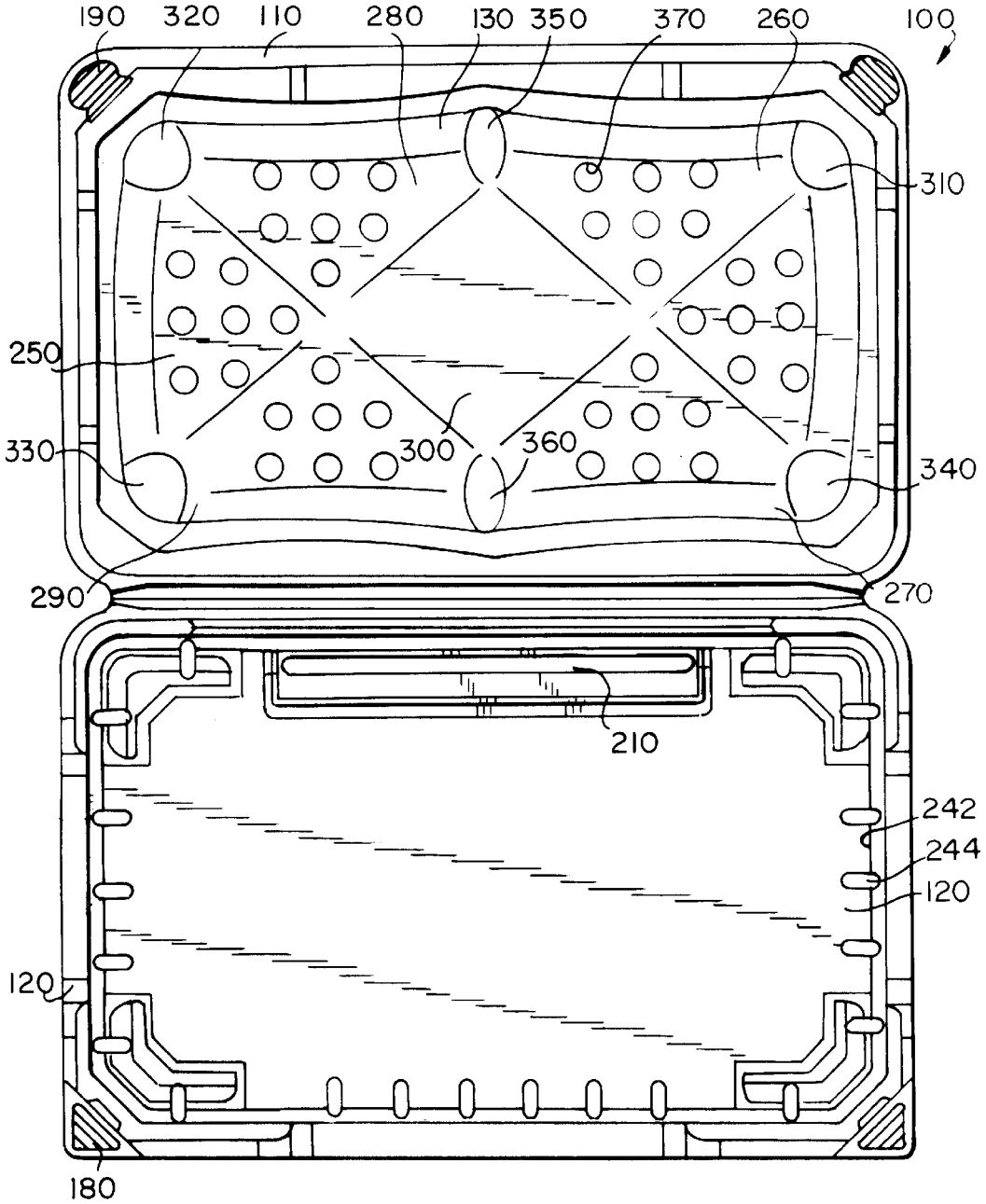
FIG. 5 is a top view of the container of FIG. 1 in an open position.

As shown in FIG. 1, the sidewall 140 is also concave at the base 130. This concavity creates a first, a second, a third, and a fourth concave region 260, 270, 280, 290 extending in a direction parallel to a minor axis of the base 130 (only the first and third concave regions 260, 280 are shown in this view, the second and fourth concave regions 270, 290 are shown in FIG. 5). The first and second concave regions 260, 270 act in the same fashion as the concave channel 250. The concave regions 260, 270 allow for air to be circulated underneath the container 100 while the container 100 is in a stacked relationship or on a flat surface. The concave regions 260, 270 extend generally perpendicular to the concave channel 250. This allows for air to be blown across the base 130 of the basket 110 along both the major and minor axes for increased circulation.

Turning now to FIG. 5, all of the four concave regions 260, 270, 280, 290 are shown. The first and second concave regions 260, 270 meet at the concave channel 250. The third and fourth concave regions 280, 290 also meet at the concave channel 250. This configuration allows for a center 300 of the base 130 to be the highest point on the base 130 and to increase the airflow that is circulated under the base 130.

In other embodiments, the concave regions 260, 270, 280, 290 may extend in a direction that is not parallel to the minor axis. The concave regions 260, 270, 280, 290 may extend outwardly at differing angles from the concave channel 250. The orientation of the concave region may depend on the design and intended use of the container 100. Furthermore, in some embodiments, there may be a plurality of concave channels 250 depending on the shape and intended use of the container 100. Also, there may be more or less concave regions depending on the design and intended use of the container 100.

Located at the corners of the base 130 are four vertical contact points 310, 320, 330, 340. The vertical contact points 310, 320, 330, 340 provide support for the container 100 and contact the surface on which the container 100 lies. In this embodiment, two other vertical contact points 350, 360 are also included. These vertical contact points 350, 360 provide further support to the sidewalls 140, 150 to keep the sidewalls 140, 150 from buckling during transport. Also, the location of the vertical contact points 310, 320, 330, 340, 350, 360 defines the initial widths of the concave channel 250 and the concave regions 260, 270, 280, 290. In some embodiments, the container may have more or less vertical contact points. Some containers may have only four vertical contact points (one at each of the four corners), while others may have as many as nine (one at each of the four corners, one between each of the corners and one in the middle). In alternative embodiments, more or less vertical contact points may be included, depending on the size and intended use of the container 100.

The concave channel 250 and the concave regions 260, 270, 280, 290 also provide cushioning for the fruit during transport. As mentioned in the background section, the fruit is often transported by trucks over long distances. In standard containers, when the fruit bounces during transport (during loading/unloading of the pallet, the truck hitting a bump in the road), the fruit comes into contact with a rigid base. This may cause the fruit to become bruised. In the present invention, however, the concave channel 250 and the concave regions 260, 270, 280, 290 are malleable and can flex when struck by the fruit. Thus, the base 130 acts as a sort of trampoline for the fruit, thus providing cushioning for the fruit. The likelihood of bruising the fruit decreases and causes less loss of fruit.

The base 130 forms a plurality of ventilation apertures 370 disposed in the concave channel 250. The ventilation apertures 370 allow the cool air to flow into the basket 110 and, thus, cool the fruit directly. In this embodiment, the ventilation apertures 370 are generally circular in shape. It is contemplated, however, that the apertures may be other shapes, such as ovals, triangles, squares, or other polygons. The ventilation apertures 370 are disposed generally symmetrically about the major and minor axes. In other embodiments, the apertures 370 may be alternatively configured.

Figure 6:
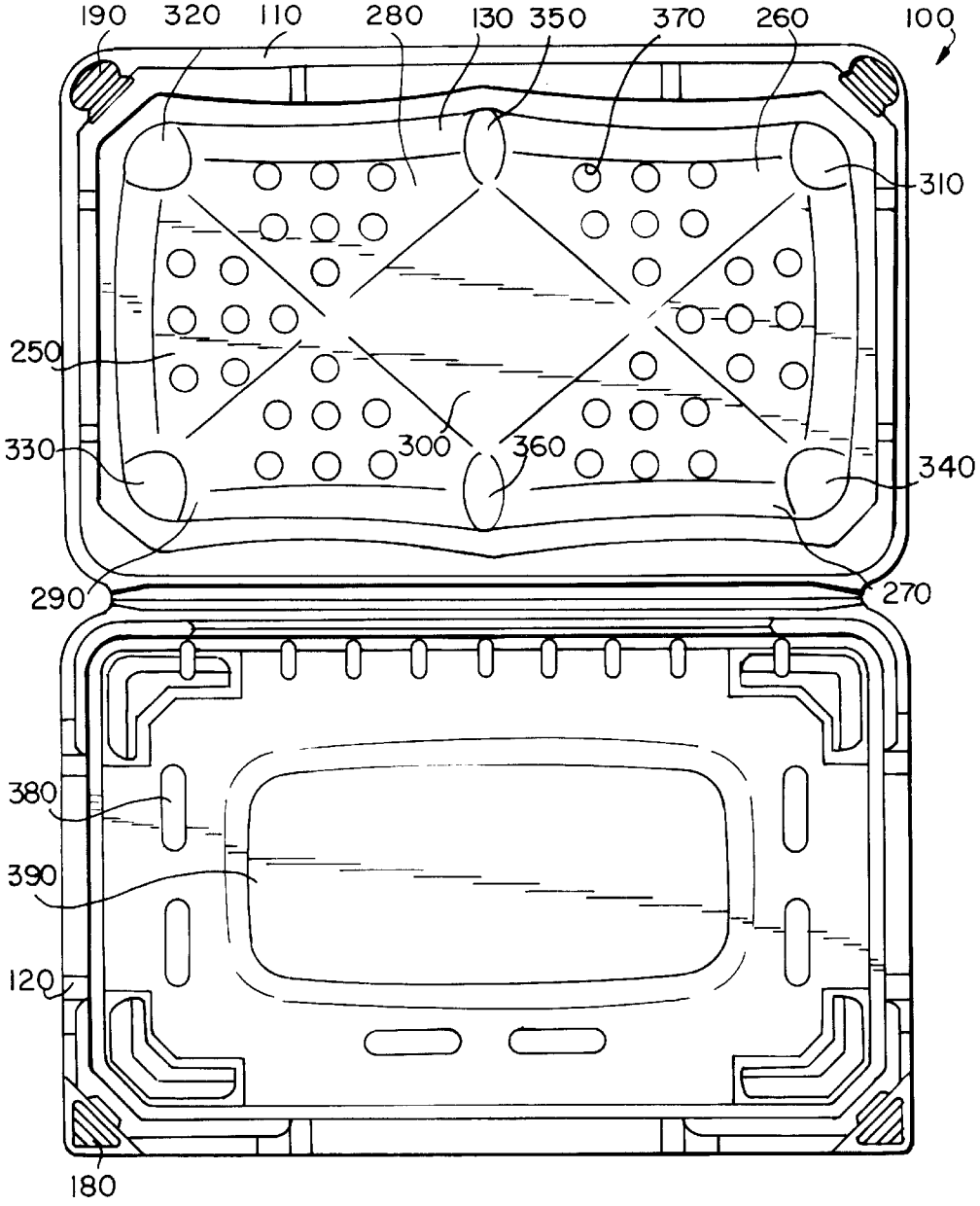
FIG. 6 is a top view of one embodiment of the lid of the container of FIG. 1.

In some embodiments, the lid 120 of the container 100 also defines a plurality of ventilation apertures 380. The ventilation apertures 380 serve to direct airflow into the container 100 to further cool the fruit. In some embodiments, an embossment 390, as illustrated in FIG. 6, is utilized to increase the flow of cool air into the container 100 and a second container when the containers are in a stacked relationship (FIG. 2). Air that is flowing over the top of the lid 120 contacts an edge of the embossment 390 and is directed up toward the second container that is stacked on top of the lid 120. This directed air may flow into the second container through ventilation apertures formed in the base.

As mentioned above, the embossment 390 and the vertical contact points 310, 320, 330, 340, 350, 360 are designed to provide a clearance between the first container 100 and another container 100' when the containers 100, 100' are in a stacked relationship. This clearance allows air to flow between the stacked containers 100, 100' and, thus, more effectively cool the fruit in the containers 100, 100'. FIG. 2 illustrates the vertical clearances between the containers 100, 100' when they are in a stacked relationship.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A hinged container, comprising:

a basket having a base, a pair of sidewalls, and a pair of endwalls, the base, pair of endwalls and pair of endwalls being integrally connected, the pair of sidewalls and the pair of endwalls integrally extending outwardly to form a first latching portion, the base forming a concave channel, a first concave region, and a second concave region, the concave channel extending parallel to a major axis of the base, the first concave region extending from the concave channel to one of the pair of sidewalls, and the second concave region extending from the concave channel to the other of the pair of sidewalls; and a lid being hingedly connected to the first latching portion, the lid having a second latching portion corresponding to the first latching portion, the first and second latching portions being adapted to retain the lid and the basket in a closed relationship.

2. The container of claim 1, wherein the concave channel, first concave region, and second concave region are adapted to provide airflow along the major axis and a minor axis.

3. The container of claim 1, wherein the pair of endwalls and pair of sidewalls are substantially smooth and in the absence of any ribbing structure.

4. The container of claim 1, wherein the base comprises a respective vertical contact point being located near each of four corners thereof, the vertical contact points are adapted to nestably engage a lid of a second container when the second container is in a stacked relationship with the container.

5. The container of claim 1, wherein the base comprises six vertical contact points, a respective vertical contact point is located near each of four corners thereof, and one vertical contact point is disposed along each of the pair of sidewalls and between two other vertical points.

6. The container of claim 1, wherein the base comprises nine vertical contact points, a respective vertical contact point is located near each of four corners thereof, one vertical contact point is disposed midway between each of the four corners, and one vertical contact point is located in the center of the base.

7. The container of claim 1, wherein the intersections of respective endwalls and sidewalls form at least four curved corners.

8. The container of claim 1, wherein the lid is constructed to stackably engage a base of a second container.

9. The container of claim 1, wherein the base further forms a plurality of ventilation a the plurality of ventilation apertures is generally symmetrically disposed along at least one of the major axis and the minor axis of the base.

10. The container of claim 1, wherein the at least one of the concave channel, first concave region, and second concave region varies in width along its length.

11. The container of claim 1, wherein the base further forms a third concave region, the third concave region extends from the concave channel to one of the pair of sidewalls, the third concave region is adjacent to the first concave region.

12. The container of claim 11, wherein the base further forms a fourth concave region, the fourth concave region extends from the concave channel to the other of the pair of sidewalls, the fourth concave region is adjacent to the second concave region.

13. The container of claim 1, wherein the base further forms at least one ventilation aperture adapted to increase airflow through the basket.

14. The container of claim 13, wherein the at least one ventilation aperture is disposed in one of the concave channel, first concave region, and second concave region.

15. The container of claim 1, wherein the lid comprises an embossment.

16. The container of claim 15, wherein the lid forms a plurality of ventilation apertures adjacent to the embossment.

17. The container of claim 15, wherein the embossment forms a plurality of ventilation apertures.

18. The container of claim 1, wherein the first latching portion and the second latching portion define a first ventilation slot when the first and second latching portions are in a closed relationship with each other.

19. The container of claim 18, wherein the lid further comprises a rim, the rim extends at least partially around the lid and forms a plurality of ventilation apertures.

20. The container of claim 18, wherein the first latching portion and the second latching portion define a plurality of ventilation apertures opposite to and in alignment with the first ventilation slot when the first and second latching portions are in a closed relationship with each other.

21. The container of claim 18, wherein the first latching portion and the second latching portion further define a second ventilation slot opposite the first ventilation slot when the first and second latching portions are in a closed relationship with each other.

22. The container of claim 21, wherein the first latching portion and the second latching portion further define a third ventilation slot when the first and second latching portions are in a closed relationship with each other, and the lid further comprising a fourth ventilation slot being located opposite of the third ventilation slot when the first and second latching portions are in a closed relationship with each other, the first ventilation slot, the second ventilation slot, and the third ventilation slot are located on a different one of the pair of sidewalls and endwalls.

23. A hinged container, comprising:

a basket having a base, a pair of generally smooth and flat sidewalls, and a pair of generally smooth and flat endwalls, the base, the pair of sidewalls, and the pair of endwalls being integrally connected, the pair of sidewalls and the pair of endwalls integrally extending outwardly to form a first latching portion, the base forming a concave channel, a first concave region, and a second concave region, the concave channel extending parallel to a major axis of the base, the first concave region extending from the concave channel to one of the pair of sidewalls, the second concave region extending from the concave channel to the other of the pair of sidewalls, the base forming a vertical contact point near each of four corners of the base, each of the vertical contact points being adapted to nestably engage a lid of a second container when the second container is in a stacked relationship with the container; and a lid being hingedly connected to the first latching portion, the lid forming a plurality of ventilation apertures, the lid having a second latching portion corresponding to the first latching portion, the first and second latching portions being adapted to retain the lid and the basket in a closed relationship, the first and second latching portions defining a first ventilation slot, a second ventilation slot opposite of the first ventilation slot, a third ventilation slot opposite of the plurality of ventilation apertures when the first and second latching portions are in a closed relationship with each other, the first ventilation slot, the second ventilation slot, and the third ventilation slot being located on a different one of the pair of sidewalls and endwalls.

24. A hinged container, comprising:

a basket having a base, a pair of generally smooth sidewalls, and a pair of generally smooth endwalls, the base, the pair of sidewalls, and the pair of endwalls being integrally connected, the pair of sidewalls and the pair of endwalls integrally extending outwardly to form a first latching portion, the base forming a concave channel, a first concave region, and a second concave region, the concave channel extending along a major axis of the base, the first concave region extending from the concave channel to one of the pair of sidewalls, and the second concave region extending from the concave channel to the other of the pair of sidewalls; and a lid being hingedly connected to the first latching portion, the lid forming a first ventilation slot, the lid having a second latching portion corresponding to the first latching portion, the first and second latching portions being adapted to retain the lid and the basket in a closed relationship, the first and second latching portions defining a second ventilation slot, a third ventilation slot, and a fourth ventilation slot opposite of the first ventilation slot when the first and second latching portions are in a closed relationship with each other, the first ventilation slot, the second ventilation slot, and the third ventilation slot being located on a different one of the pair of sidewalls and endwalls.

25. A hinged container, comprising:

a basket having a base, a pair of sidewalls, and a pair of endwalls, the base, the pair of sidewalls, and the pair of endwalls being integrally connected, the pair of sidewalls and the pair of endwalls integrally extending outwardly to form a first latching portion; and a lid being hingedly connected to the first latching portion along a major axis, the lid having a second latching portion corresponding to the first latching portion, the first and second latching portions being adapted to retain the lid and the basket in a closed relationship, the first and second latching portions defining a first ventilation slot and a second ventilation slot opposite of the first ventilation slot when the first and second latching portions are in a closed relationship relative to each other, the first and second ventilation slots extending parallel to a major axis of the container.

26. The container of claim 25, wherein the pair of endwalls and pair of sidewalls are substantially smooth and in the absence of any ribbing structure.

27. The container of claim 25, wherein the lid further comprises a rim, the rim extends at least partially around the lid and forms a plurality of ventilation apertures.

28. The container of claim 25, wherein the first latching portion and the second latching portion further define a pair of third ventilation slots when the first and second latching portions are in a closed relationship with each other.

29. The container of claim 25, wherein the base comprise a respective vertical contact point being located near each of four corners thereof, the vertical contact points is adapted to nestably engage a lid of a second container when the second container is in a stacked relationship with the container.

30. The container of claim 25, wherein the base comprises at least six vertical contact points, a respective vertical contact point is located near each of four corners thereof, and one vertical contact point disposed along each of the pair of sidewalls, between two other vertical points.

31. The container of claim 25, wherein the base comprises nine vertical contact points, a respective vertical contact point is located near each of four corners thereof, one vertical contact point is disposed midway between each of the four corners, and one vertical contact point is located in the center of the base.

32. The container of claim 25, wherein the intersections of respective endwalls and sidewalls form at least four curved corners.

33. The container of claim 25, wherein the lid is constructed to stackably engage a base of a second container.

34. The container of claim 25, wherein the base further forms a plurality of ventilation apertures, the plurality of ventilation apertures is generally symmetrically disposed along at least one of the major axis and the minor axis of the base.

35. The container of claim 25, wherein the first and second ventilation slots extend along a majority of the major axis.

36. The container of claim 35, wherein the first and second ventilation slots extend along a major portion of the major axis.

37. The container of claim 25, wherein the second ventilation slot is located adjacent to the second latching portion and extends in a direction generally parallel to the major axis.

38. The container of claim 25, wherein the base forms:

a concave channel extending parallel to a major axis of the base;

a first concave region extending from the concave channel to one of the pair of sidewalls;

a second concave region extending from the concave channel to the other of the pair of sidewalls;

a third concave region extending from the concave channel to one of the pair of sidewalls, the third concave region being adjacent to the first concave region; and a fourth concave region extending from the concave channel to the other of the pair of sidewalls, the fourth concave region being adjacent to the second concave region.

39. The container of claim 38, wherein at least one of the concave channel, first concave region, second concave region, third concave region, and fourth concave region varies in width along its length.

40. The container of claim 25, wherein the base further forms at least one ventilation aperture adapted to increase airflow through the basket.

41. The container of claim 40, wherein the at least one ventilation aperture is disposed in one of the concave channel, first concave region, and second concave region.

42. The container of claim 25, wherein the lid comprises an embossment.

43. The container of claim 42, wherein the lid forms a plurality of ventilation apertures adjacent to the embossment.

44. The container of claim 43, wherein the embossment forms a plurality of ventilation apertures.

45. The container, comprising:

a basket having a base, a pair of sidewalls, and a pair of endwalls, the base the pair of endwalls and the pair of endwalls being integrally connected, the pair of sidewalls and the pair of endwalls integrally extending outwardly to form a first latching portion, the base forming a concave channel, a first concave region, and a second concave region, the concave channel extending from one end to the other end of a major axis of the base, the first concave region extending from the concave channel to one of the pair of sidewalls, and the second concave region extending from the concave channel to the other of the pair of sidewalls; and a lid adapted to connect to the first latching portion, the lid having a second latching portion corresponding to the first latching portion, the first and second latching portions being adapted to retain the lid and the basket in a closed relationship.

46. The container of claim 45, wherein the pair of endwalls and pair of sidewalls are substantially smooth and in the absence of any ribbing structure.

47. A hinged container, comprising:

a basket having a base, a pair of sidewalls, and a pair of endwalls, the base, the pair of endwalls and the pair of sidewalls being integrally connected, the pair of sidewalls and the pair of endwalls integrally extending outwardly to form a first latching portion, the base forming a concave channel, a first concave region, and a second concave region, the concave channel extending parallel to a major axis of the base, the first concave region extending from the concave channel to one of the pair of sidewalls, and the second concave region extending from the concave channel to the other of the pair of sidewalls, the first concave region extending along a majority of one of the pair of sidewalls, the second concave region extending along a majority of the other of the pair of sidewalls; and a lid being hingedly connected to the first latching portion, the lid having a second latching portion corresponding to the first latching portion, the first and second latching portions being adapted to retain the lid and the basket in a closed relationship.

48. The container of claim 47, wherein the first concave region extends substantially along the entire length of one of the pair of sidewalls, and the second concave region extends substantially along the length of the other of the pair of sidewalls.

49. A container, comprising:

a basket having a base, a pair of sidewalls, and a pair of endwalls, the base, the pair of sidewalls and the pair of endwalls being integrally connected, the pair of sidewalls and the pair of endwalls integrally extending outwardly to form a first latching portion, the base forming a concave channel, a first concave region, and a second concave region, the concave channel extending parallel to a major axis of the base, the first concave region extending from the concave channel to one of the pair of sidewalls, and the second concave region extending from the concave channel to the other of the pair of sidewalls, the first concave region extending along a majority of one of the pair of sidewalls, the second concave region extending along a majority of the other of the pair of sidewalls; and a lid being adapted to connect to the first latching portion, the lid having a second latching portion corresponding to the first latching portion, the first and second latching portions being adapted to retain the lid and the basket in a closed relationship.

50. The container of claim 49, wherein the first concave region extends substantially along the entire length of one of the pair of sidewalls, and the second concave region extends substantially along the other of the pair of sidewalls.

51. A hinged container, comprising:

a basket having a base, a pair of sidewalls, and a pair of endwalls, the base, the pair of sidewalls, and the pair of endwalls being integrally connected, the pair of sidewalls and the pair of endwalls integrally extending outwardly to form a first latching portion; and a lid being hingedly connected to the first latching portion, the lid having a second latching portion corresponding to the first latching portion, the first and second latching portions being adapted to retain the lid and the basket in a closed relationship, the first and second latching portions defining a first ventilation slot and a second ventilation slot opposite of the first ventilation slot when the first and second latching portions are in a closed relationship relative to each other and a third ventilation slot, the first and second ventilation slots extending parallel to a major axis of the container, the lid further including a fourth ventilation slot, the first, second, third and fourth ventilation slots being located on a different one of the pair of sidewalls and endwalls.

* * * * *